US005511453A

United States Patent [19]

Neumann et al.

[11] Patent Number: 5,511,453

[45] Date of Patent: Apr. 30, 1996

[54] PLIERS FOR MOUNTING PURPOSES

[75] Inventors: Rainer Neumann, Herten; Dieter Schwalm, Bielefeld, both of Germany

[73] Assignee: Vulkan Lokring GmbH & Co. KG, Herne, Germany

[21] Appl. No.: 293,042

[22] Filed: Aug. 19, 1994

[30] Foreign Application Priority Data

Aug. 20, 1993 [DE] Germany ..... 9312480 U
Sep. 25, 1993 [DE] Germany ..... 43 32 710.9

[51] Int. Cl.[6] ..... B25B 7/12

[52] U.S. Cl. ..... 81/362; 81/352; 81/357

[58] Field of Search ..... 81/362, 318–324, 81/352, 355, 357, 313, 314

[56] References Cited

U.S. PATENT DOCUMENTS

| | | | |
|---|---|---|---|
| 2,643,564 | 6/1953 | Klein et al. | 81/320 X |
| 2,993,275 | 7/1961 | Naito | 30/250 |
| 3,084,432 | 4/1963 | Hill | 81/314 X |
| 4,742,737 | 5/1988 | Hatfield | 81/357 X |

FOREIGN PATENT DOCUMENTS

| | | | |
|---|---|---|---|
| 3617529 | 11/1987 | Germany . | |
| 249812 | 2/1927 | United Kingdom | 30/191 |

*Primary Examiner*—D. S. Meislin
*Attorney, Agent, or Firm*—Robert W. Becker & Associates

[57] ABSTRACT

A pliers for mounting purposes has two plier portions pivotably connected by a first pivot connection. Each plier portion has a jaw base body and a grip of a length that is a multiple of the length of the jaw base body. A first grip is divided into a first and second section. The first section, shorter than the second section, is located between the jaw base body and the second section. A second pivot connection pivotably connects the first and second sections and has a pivot bolt extending parallel to the pivot axis of the first pivot connection. A sprocket wheel and a ratchet wheel are rotatably connected to the pivot bolt and fixedly connected to one another. A chain connected to the second grip is guided across the sprocket wheel to the second section and extends in the longitudinal direction toward a tension spring at which it is fastened. A spring-biased follower pawl is connected to the second section such that upon closing the second section sprocket wheel and ratchet wheel rotate to close the pliers. The ratchet wheel has an outer toothing engaged by a spring-biased locking pawl that allows rotation of the ratchet wheel in a first direction during closing of the pliers but prevents rotation in the counter direction. A pin, connected to the locking pawl and accessible from the exterior of the pliers, is provided for disengaging the locking pawl temporarily from the outer toothing.

8 Claims, 4 Drawing Sheets

PLIERS FOR MOUNTING PURPOSES

BACKGROUND OF THE INVENTION

The present invention relates to a hand-held pliers for mounting purposes, especially for sliding sleeve tube connection systems wherein the pliers has two plier portions and a first pivot connection for pivotably connecting the two plier portions. Each plier portion comprises a jaw base body and a grip of a length that is a multiple of the length of the jaw base body. A first one of the grips is divided into a first section and a second section, whereby the first section is located between the jaw base body and the second section and is shorter than the second section. A second pivot connection for pivotably connecting the first section and the second section is provided. The second pivot connection comprises a pivot bolt extending parallel to a pivot axis of the first pivot connection. A sprocket wheel and a ratchet wheel with an outer toothing are rotatably connected to the pivot bolt. The sprocket wheel and the ratchet wheel are positioned axially adjacent to one another on the pivot bolt and are fixedly connected to one another. A chain having a first end connected to the second one of the grips is provided. A tension spring for connecting the second end of the chain to the second section of the first grip is provided. The chain is guided from the second grip across the sprocket wheel so as to be engaged by the sprocket wheel to the second section where the chain extends in the longitudinal direction of the second section toward the tension spring. A spring-biased follower pawl is connected to the second section such that upon a closing movement of the second section the sprocket wheel and the ratchet wheel perform a rotational movement resulting in a closure of the pliers.

A pliers of the aforementioned kind is known from German Patent 36 17 529. With the pivot mechanism in conjunction with the tensioning chain the clamping action provides for a much greater total transmission ratio and thus a correspondingly greater mounting force as compared to a conventional pliers with similar construction. When such a pliers is to be used for mounting non-metallic tube systems of relatively large diameters, correspondingly great mounting forces are required. In this context, due to the elasticity of the pliers and especially due to the unavoidable tolerances of the joint parts connected to one another, it is possible that during the clamping movement an elastic rebound may occur so that the follower pawl cannot engage the next tooth gap and a further increase of the clamping force is no longer possible.

It is therefore an object of the present invention to provide a pliers for mounting purposes with which even under extremely high mounting forces the pliers can be continuously closed without problems until the final position has been reached without experiencing elastic rebound.

SUMMARY OF THE INVENTION

The pliers for mounting purposes according to the present invention is primarily characterized by:

Two plier portions;

A first pivot connection for pivotably connecting the two plier portions;

Each plier portion comprised of a jaw base body and a grip of a length that is a multiple of the length of the working portion;

A first grip divided into a first section and a second section, the first section located between the jaw base body and the second section and being shorter than the second section;

A second pivot connection for pivotably connecting the first section and the second section;

The second pivot connection comprising a pivot bolt extending parallel to a pivot axis of the first pivot connection;

A sprocket wheel rotatably connected to the pivot bolt;

A ratchet wheel with an outer toothing rotatably connected to the pivot bolt;

The sprocket wheel and the ratchet wheel positioned axially adjacent to one another on the pivot bolt and fixedly connected to one another;

A chain having a first end connected to the second grip;

A tension spring for connecting a second end of the chain to the second section of the first grip;

The chain guided from the second grip across the sprocket wheel so as to be engaged by the sprocket wheel to the second section, where the chain extends in a longitudinal direction of the second section toward the tension spring;

A spring-biased follower pawl connected to the second section such that upon closing the second portion the sprocket wheel and the ratchet wheel perform a rotational movement resulting in closing of the pliers;

The outer toothing of the ratchet wheel extending over the entire circumference of the ratchet wheel;

A spring-biased locking pawl for engaging the outer toothing, the locking pawl allowing a rotation of the ratchet wheel in a first direction during closing of the pliers but preventing a rotation of the ratchet wheel in a second direction counter to the first direction; and An actuating member, connected to the locking pawl and accessible from the exterior of the pliers, for pivoting the locking pawl temporarily from engagement with the outer toothing into a disengaged position.

Preferably, the first section has a wall with a slotted hole and the actuating member is a transverse pin fixedly connected to the locking pawl and projecting perpendicularly from the locking pawl into the slotted hole so as to be guided therein. The transverse pin has a free end extending through the slotted hole and projecting past the wall of the first section.

The pliers preferably further comprises a slide slidably connected to the second section and having an end face with glide surface, wherein the glide surface of the slide in an initial position of the slide is positioned adjacent to the transverse pin.

Advantageously, the slide has at least two slotted holes and the second section has at least two bolts engaging respectively the at least two slotted holes for guiding the slide.

Expediently, one of the at least two bolts is an axial extension of the pivot bolt.

Preferably, the follower pawl has a pin connected thereto so as to extend perpendicularly from the follower pawl. The slide has a lateral nose that during a return movement of the slide into the initial position acts on the pin of the follower pawl such that the follower pawl is moved into a release position.

The first section preferably comprises a bolt. The locking pawl is pivotably connected to the bolt and the locking pawl comprises a spring for biasing the locking pawl into engagement with the outer toothing.

Expediently, the pliers further comprises a stationary glide member located within a circumferential area in which the chain abuts on the sprocket wheel so as to be positioned with play adjacent to the chain.

According to the present invention, the ratchet wheel has an outer toothing extending substantially over the entire circumference of the ratchet wheel. Furthermore, a spring-biased locking pawl is provided that cooperates or engages the circumferential outer toothing of the ratchet wheel. The locking pawl allows a rotation of the ratchet wheel during clamping or closing of the pliers, but prevents a rotation in the counter direction. Furthermore, the pliers comprises an actuating member connected to the locking pawl and accessible from the exterior of the pliers with which actuating member the locking pawl can be temporarily moved from engagement with the outer toothing of the ratchet wheel into a disengaged position.

According to a first advantageous embodiment the actuating member connected to the locking pawl is in the form of a transverse pin which is guided within a slotted hole of the first section of the first grip and which projects with its free end past the wall of the first section of the grip.

The locking pawl is advantageously pivotably supported at a bolt provided at the first section and is subjected continuously to the force of a compression spring which biases the locking pawl into engagement with the outer toothing.

According to another advantageous embodiment of the present invention, the chain is guided such that an accidental lifting of the chain from the teeth of the sprocket wheel is prevented. For this purpose, in the area in which the chain rests on the sprocket wheel, a stationary glide member is provided and connected to the first section so as to be positioned with play adjacent to the chain.

In another preferred embodiment of the present invention, a measure for simplifying the disengagement of the locking pawl is suggested. For this purpose, the second section of the first grip is provided with a slide having a glide surface at one end face and being displacable to a limited extent alongside the second section of the grip. In an initial position the end face of the slide is located adjacent to the transverse pin of the locking pawl. For securing and guiding the slide d two spaced-apart slotted holes are preferably provided whereby each of the slotted holes is preferably engaged by a bolt connected to the first grip. One of these bolts can advantageously be an axial extension of the pivot bolt.

The follower pawl, if so desired, can also be pivotable into a release position with the aid of the slide. For this purpose, according to a further embodiment of the present invention, a pin is connected to the follower pawl and the slide is provided at its inner longitudinal side with a lateral nose that during a return movement of the slide into the initial position acts on the pin such that the follower pawl is moved from its engagement position into a release position.

An important advantage that can be achieved with the present invention is that during the course of closing the pliers during which closing the required high clamping forces must be exerted, there is no risk of elastic rebound of the plier parts. This is prevented by the locking pawl which automatically engages between the individual teeth of the ratchet wheel. In this manner, the clamping action can be interrupted at any desired intermediate position. It is furthermore advantageous that the previously generated clamping pressure is substantially maintained so that there is no risk of the clamping jaws of the pliers sliding off the tube connection. The removal of the pliers after completed mounting is carried out by simply pivoting the locking pawl out of engagement by means of the laterally projecting pin. The glide member which is also provided provides an additional safety against a possible upward sliding of the chain off the sprocket wheel.

When handling the pliers, each hand of the user must hold one grip. When desired, the slide can be moved by pressing on it with the thumb, and it is thus possible to disengage the locking pawl. Accordingly, the disengagement can be performed with both hands being in the required operational position, i.e., removing a hand from the grip is not necessary in order to perform the disengagement of the locking pawl. This advantage is also provided for pivoting the follower pawl into a release position when during operation of the pliers the follower pawl temporarily is to be released.

BRIEF DESCRIPTION OF THE DRAWINGS

The object and advantages of the present invention will appear more clearly from the following specification in conjunction with the accompanying drawings, in which:

FIG. 3 shows in a side view a detail of FIG. 2 in the area of the second pivot connection as.

DESCRIPTION OF PREFERRED EMBODIMENTS

Figure 1:
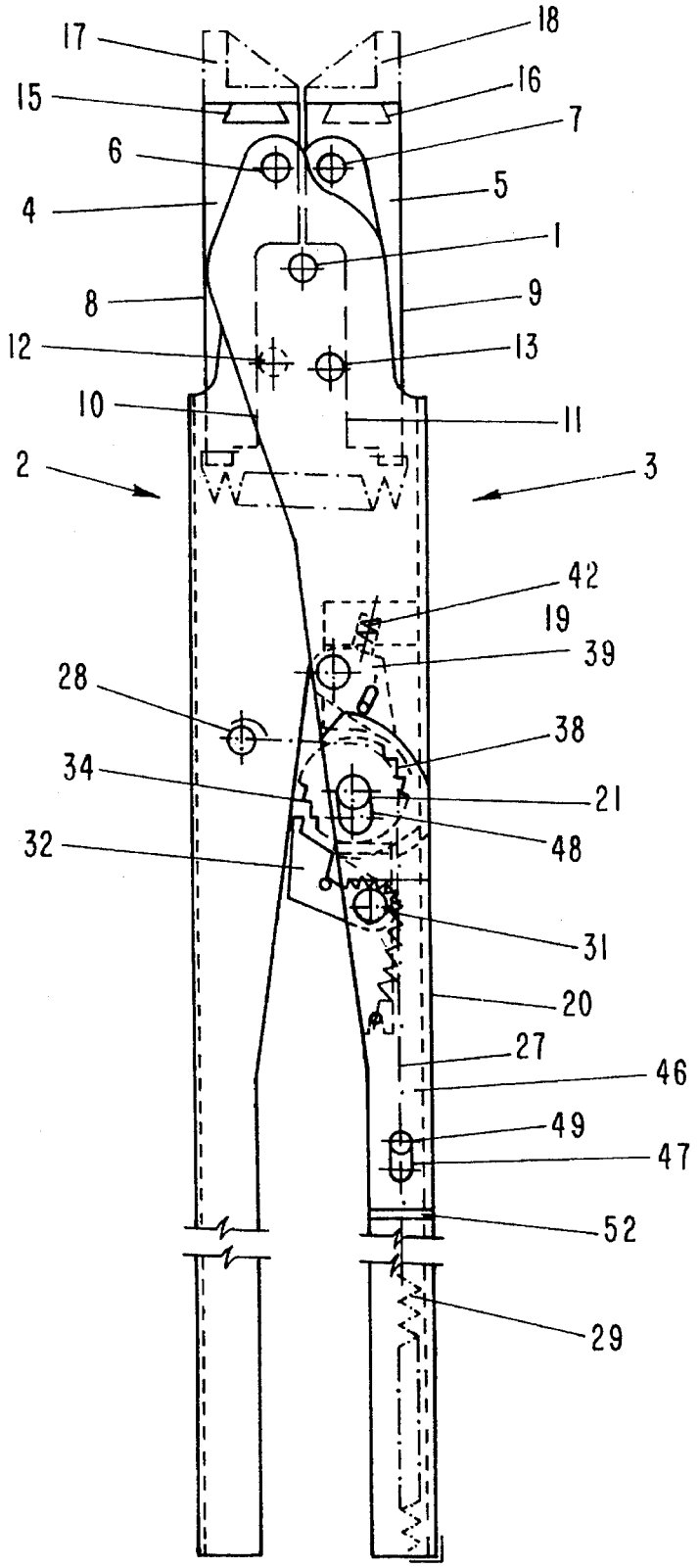
FIG. 1 shows a side view of the pliers in the closed position.

The present invention will now be described in detail with the aid of several specific embodiments utilizing FIGS. 1 through 4.

The represented pliers comprises two plier portions that are connected to one another with a pivot connection in the form of a pivot bolt 1. The plier portions each have a grip 2, 3. The two plier portions are comprised in general of U-shaped sheet metal profiles that with the open side of the "U" face one another. At the head portion of the pliers the sheet metal profiles are forked so that the legs of the grip 3 receive the legs of the grip 2. The pivot bolt 1 is axially secured in aligned bores of the plier portions.

At the free ends of the plier portions within the head region jaw base bodies 4, 5 are connected pivotably with bearing bolts 6, 7 to the grips 2, 3. At the inwardly oriented ends the base bodies 4 and 5 are provided with a guide 8 and 9 with an inner straight support surface 10, 11. Each support surface 10, 11 rests on an abutment pin 12, 13 provided at the grips 2 and 3. The bearing bolts 6, 7 and the abutments in the form of pins 12, 13 with their axes form the pivot points of a quadrangular pivot arrangement. A tension spring 14 engaging the ends of the guides 8, 9 has the task to maintain the guides 8, 9 in their abutment position on the pins 12, 13. Upon opening and closing the pliers the jaw base bodies 4, 5 move relative to one another while maintaining their parallel orientation.

Figure 2:
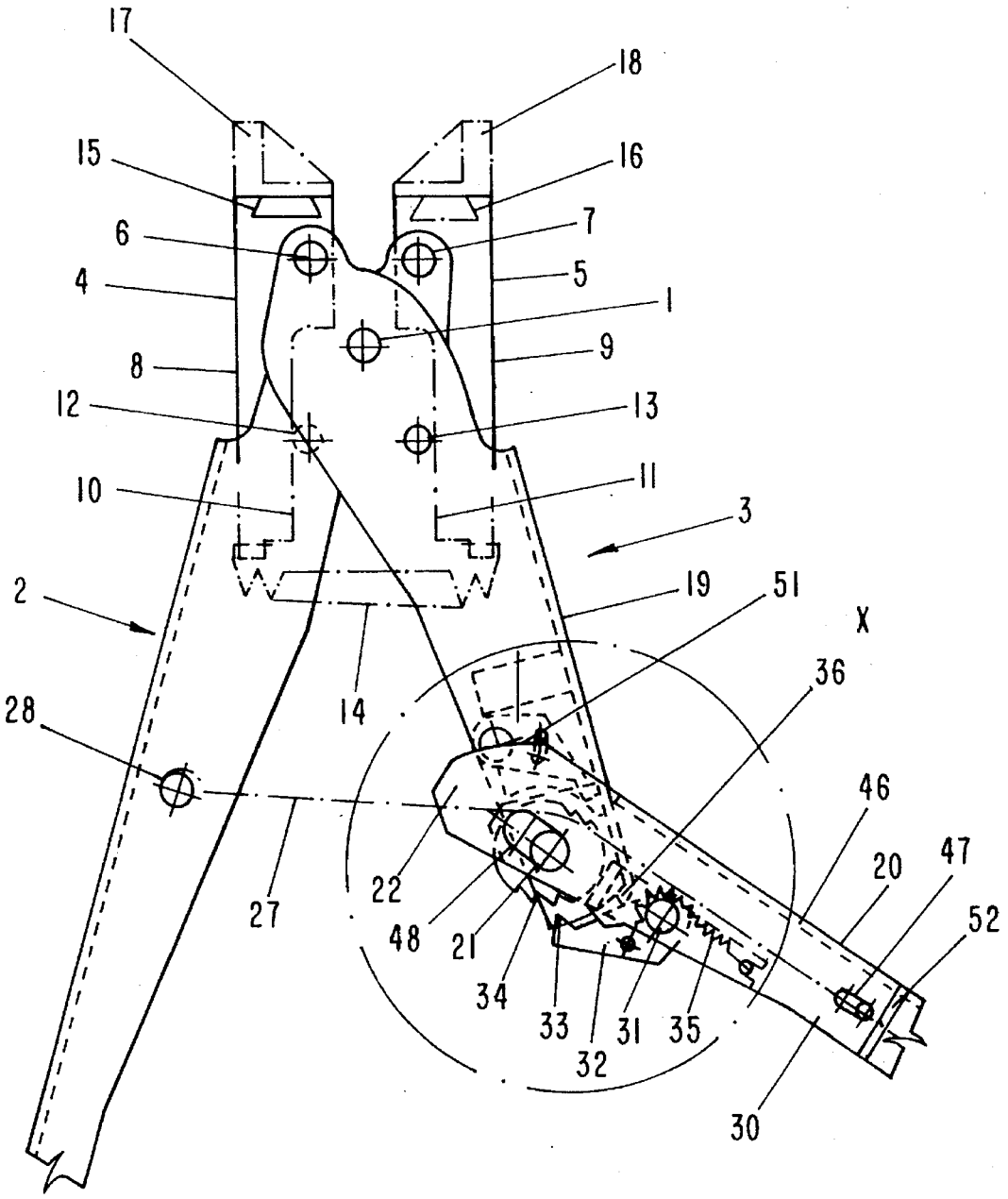
FIG. 2 shows a side view of the pliers in the open position.

The two jaw base bodies 4, 5 at their forward ends are provided with blind grooves 15, 16 extending transverse to the direction of movement of the plier portions and having a dove-tail profile (see FIGS. 1 and 2). The blind grooves 15, 16 are positioned on opposite sides of the jaw base bodies 4, 5 and open in the upward direction.

Connected to the jaw base bodies 4, 5 are exchangeable mounting jaws 17, 18 that are connectable to the blind grooves 15, 16 by means of a profiled projection. Each mounting jaw 17, 18 comprises a U-shaped receiving channel that during mounting receive parts of the tube connection to be produced between them, which parts upon manufacturing the tube connection with the aid of the mounting pliers are axially pressed toward one another in order to be pressed onto a connector.

By providing mounting jaws 17, 16 with receiving channels of different inner diameters and profiles or cross-sections, the pliers is universally suitable for producing a sliding sleeve tube connection system of different diameters and designs.

While the grip 2 is of an undivided construction, the other grip 3, which corresponds in its shape essentially to grip 2, is divided in the vicinity of the head portion of the pliers into an inner, shorter first section 19 and an outer, longer second section 20. The first and second sections 19, 20 are pivotably connected with a second pivot connection in the form of a bolt 21. The ends of the first and second sections 19, 20 that are facing one another are formed such that the outer section 20 is forked whereby the fork legs 22 receive the free end of the inner first section 19 therebetween. The pivot bolt 21 is positioned in aligned bores 23 of the legs of the two sections 19, 20 and is axially fixed.

Figure 4:
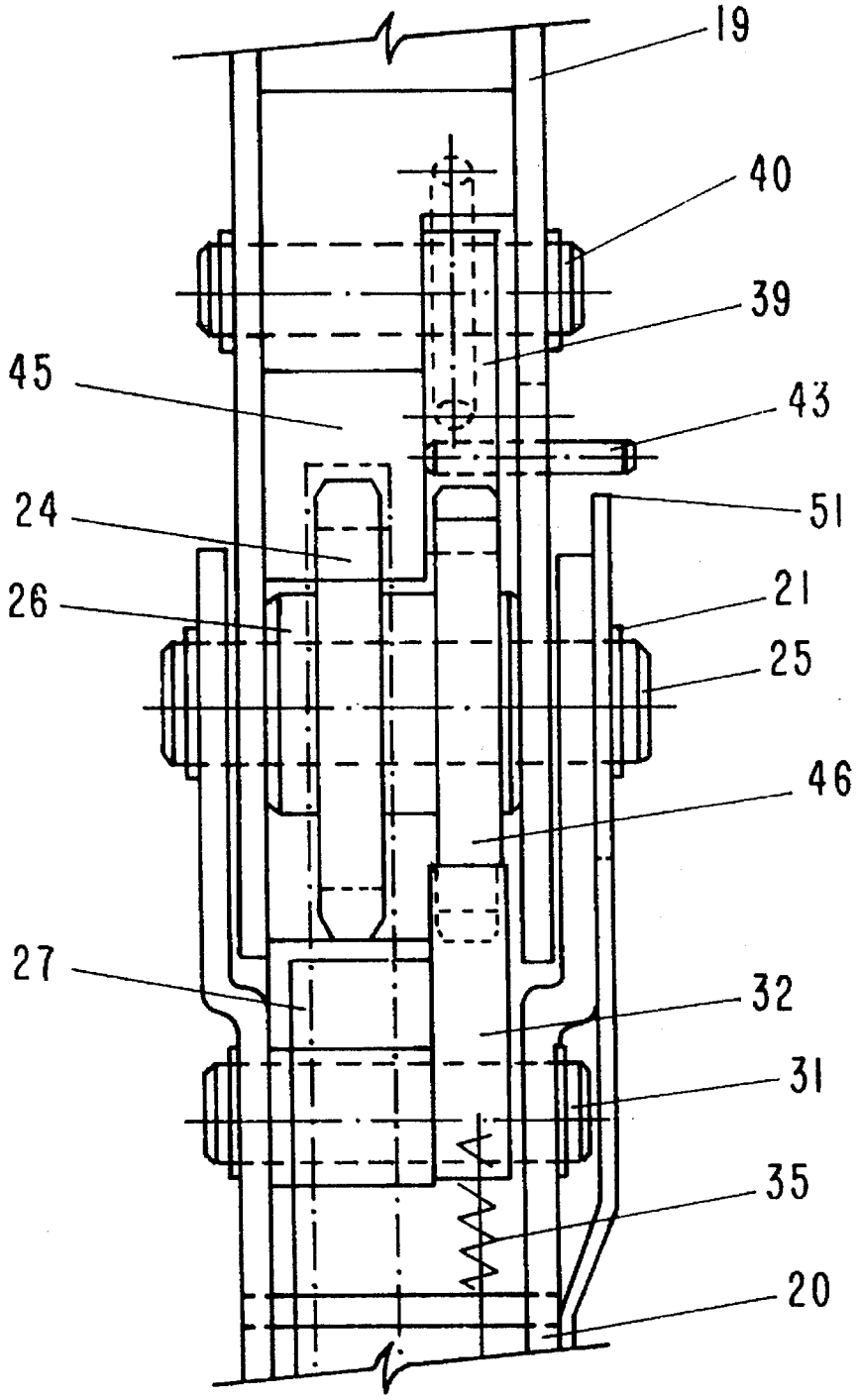
FIG. 4 shows a front view of the second pivot connection from the interior of the pliers.

As can be seen especially in FIG. 4, the pivot bolt 21 is simultaneously used as a bearing bolt for a sprocket wheel 24 and a ratchet wheel 25 with an outer toothing 34, 38. The ratchet wheel 25 is fixedly connected to the sprocket wheel 24. Sprocket wheel 24 and ratchet wheel 25 are fixedly connected to a sleeve 26 which extends with its axial length with little play between the legs of the inner first section 19. Sprocket wheel 24, ratchet wheel 25, and sleeve 26 may also be formed as a unitary part. The sprocket wheel 24 guides a chain 27, preferably in the form of a sprocket chain, that with one end is connected to a pin 28 at the grip 2. In the other direction the chain 27 extends into the interior of the U-shaped outer second section 20 whereby its free end is connected via a tension spring 29 to the second section 20. The tension spring 29 serves to tension the portion of the chain 27 that is not under load.

At the lower end of the forked portion of the second section 20 a pawl pin 31 is located in bores of legs 30 of the second section 20 and is secured against axial displacement in a suitable manner. This pawl pin 31 is provided in the plane of the ratchet wheel 25 with a follower pawl 32 that with its nose 33 engages the circumferential outer toothing 34 of the ratchet wheel 25. A securing spring 35 acts on the follower pawl 32 such that the follower pawl 32 is maintained in its engagement position with the ratchet wheel 25.

Figure 3:
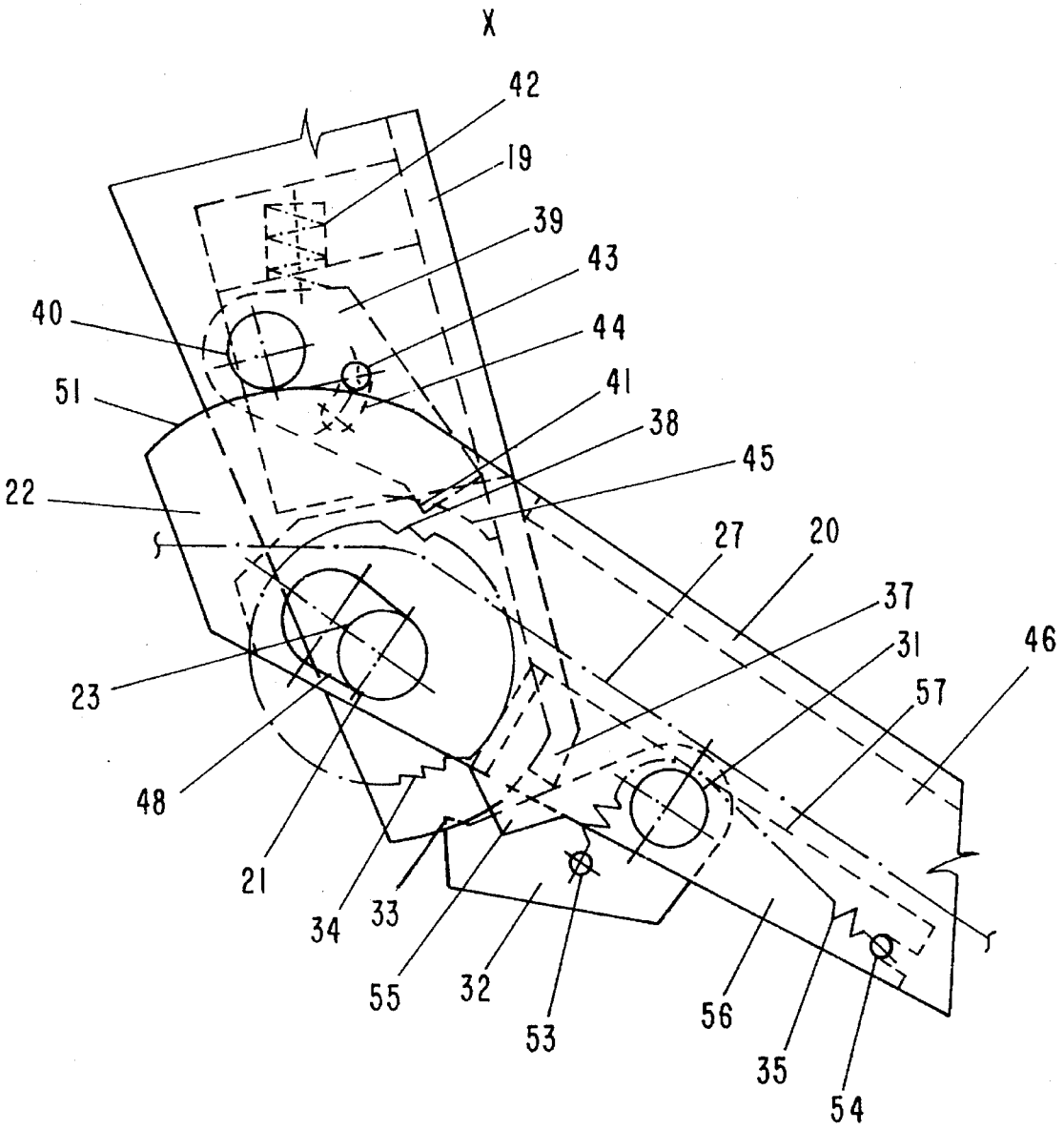

As shown in FIGS. 2 and 3, the second section 20 can be pivoted from its rest position, shown in FIG. 1, relative to the first section 19 outwardly into an end position that is limited by an abutment. The abutment is essentially in the form of the end faces of the legs of the U-shaped profiles of the two sections 19, 20. Before reaching the end position the pivot movement of the second section, the follower pawl 32 is automatically pivoted from engagement into a release position. For this purpose, at the leg of the first section 19 an abutment nose 36 is provided with which the inner gliding surface 37 of the follower pawl 32 is brought into pressure contact at the beginning of the end phase of the pivoting movement.

When the pliers is being opened, the second section 20 is first pivoted into the end position represented in FIG. 2. Only thereafter a spreading movement of the grip 2 and the first section 19 takes place resulting in a spreading of the mounting jaws 17, 18. When closing the pliers, in the aforementioned parts are pressed against one another a first movement until the mounting jaws 17, 18 come into contact with the parts of the tube connection to be mounted. Subsequently, the pivoting movement of the second section 20 occurs, whereby the follower pawl 32 is released and with its nose 33 engages the outer toothing 34 of the ratchet wheel 25. Upon further movement of the second section 20 the ratchet wheel 25 and thus also the sprocket wheel 24 is rotated in the clockwise direction relative to the representation in FIG. 2. Due to its rotation, of the sprocket wheel 24 is moved along the chain 27 so that the chain section between the anchoring at pin 28 and the sprocket wheel 24 is tensioned. This tensioning acts on the grip 2 and the inner first section 19 so that these two parts are forced toward one another in order to close the pliers.

During the closing movement of the second section 20 a two-armed lever is active: one arm, i.e., the arm between the pivot axis of the pivot bolt 21 and the chain-supporting section of the sprocket wheel 24 is relatively short and the other arm, which extends from the pivot axis of the pivot bolt 21 to the end of the second section 20, is substantially longer. For a pliers of conventional dimensions, the ratio of these two effective lever arms can be, for example, 1 to 6 or more. Correspondingly, the achievable mounting (clamping) force can be increased relative to conventional pliers by a factor 6 or more.

With the aid of the following devices an automatic locking is achieved during closing of the pliers (clamping action) and thus an undesired or accidental elastic rebound is prevented. At the side of the ratchet wheel 25 facing away from the follower pawl 32 a locking pawl 39 is provided that cooperates with the outer toothing of the ratchet wheel 25. The locking pawl 39 is pivotably supported at a fixedly arranged bolt 40 within the interior of the first section 19 and pivotable to a limited extent. The locking pawl 39 is provided at its free end with a locking tooth 41 that can engage the outer toothing 38. The locking pawl 39 is biased by a compression spring 42 that maintains the locking pawl 39 in its engaged position. The locking tooth 41 and the outer toothing 38 are formed such that the locking pawl 39 allows a rotation of the ratchet wheel 25 in a clockwise direction, relative to the representation of FIG. 3, but prevents a rotation in the counter direction.

A pin 43 is connected to the locking pawl 39 and is guided in an arcuate slotted hole 44 of the first section 19. By engaging the pin 43 the locking pawl 39 can be temporarily pivoted into a disengaged position so that after completion of a tensioning or clamping operation (closing of the pliers), the plier portions that are under tension can be released.

Furthermore, within the first section 19 a fixedly connected gliding member 45 is provided that is positioned adjacent to the chain 27 within the circumferential area in which the chain 27 rests on the sprocket wheel 24. The gliding member is designed to prevent an upward movement of the chain 27 while it is being tensioned.

The outward pivoting of the locking pawl 39 from its engaged position into a disengaged position, as mentioned above, can be achieved manually by displacing the transverse pin 43. In order to be able to disengage the locking pawl 39 without letting go of the second section 20, a "remote control" is provided. This "remote control" is comprised essentially of an elongate slide 46 which is slidably supported on the side of the second portion 20. For guiding and securing the slide 46 two slotted holes 47 and 48 are provided. The rearward end of the slide 46 is guided with slotted hole 47 at a fixedly positioned bolt 49 and the forward end is guided with slotted hole 48 at the pivot bolt 21. The bolt 49 has a flat head of a greater diameter in order to prevent an accidental sliding off of the slide 46. The pivot bolt 21 is provided with an axial extension corresponding to the thickness of the slide 46. The parts are connected and held together by a removable spring ring 50.

The inner end face of the slide 46 is in the form of a curved gliding surface 51 which in the initial position of the slide 46 is adjacent to the transverse pin 43. In order to be able to grip the slide 46 the lower free end is bent to form a projecting leg 52.

When handling the pliers, during which the hands of the user hold the grips 2, 3, the slide 46 can be displaced by pressure with the thumb from its initial position (FIG. 1) in the upward direction whereby the gliding surface 51 engages the pin 43 and moves it into the other end position defined by the slotted hole guiding path in which other end position the locking pawl 39 is disengaged. It is also possible to return the slide 46 with the thumb into the initial position so that the locking pawl 39 under the return force of the spring 42 can be pivoted back into engagement.

By disengaging the locking pawl 39, the follower pawl 32 is automatically loaded which can lead to the follower pawl 32 not automatically pivoting into its release position. In order to be able to pivot in such cases the follower pawl 32 manually, the follower pawl 32 is provided with a pin 53. In the shown embodiment the pin 53 simultaneously serves to secure the securing spring 35 in the form of a tension spring that with its other end is connected at a pin 54 fastened to the second section 20.

The outward pivoting of the follower pawl 32 can also be achieved with the aid of slide 46 which for this purpose is provided at its inner longitudinal side with a nose 55. During the return movement of the slide 46 into the initial position, the nose 55 abuts on the pin 53 and thus effects a pivoting of the follower pawl 32 into the release position.

Upon extremely high loads the force exerted by the sprocket wheel 24 onto the chain 27 is correspondingly high and due to the resulting pressure force onto the teeth it may occur that the rearward portion of the chain 27 extending within the second section 20 cannot be released from the sprocket wheel 24. For securing the release a glide rail 56 is thus provided within the interior of the second section 20 which with a straight glide surface 57 extends parallel to the rearward portion of the chain 27. The glide rail 56 which essentially serves as a chain deflector is connected on the one hand with a bore and a recess to the rearward end of the pawl pin 31 and on the other hand to the pin 54.

The present invention is, of course, in no way restricted to the specific disclosure of the specification and drawings, but also encompasses any modifications within the scope of the appended claims.

What is claimed is:

1. A pliers for mounting purposes comprising:

two plier portions;

a first pivot connection for pivotably connecting said two plier portions;

each said plier portion comprised of a jaw base body and a grip of a length that is a multiple of the length of said jaw base body;

a first one of said grips divided into a first section and a second section, said first section located between said jaw base body and said second section and being shorter than said second section;

a second pivot connection for pivotably connecting said first section and said second section;

said second pivot connection comprising a pivot bolt extending parallel to a pivot axis of said first pivot connection;

a sprocket wheel rotatably connected to said pivot bolt;

a ratchet wheel with an outer toothing rotatably connected to said pivot bolt;

said sprocket wheel and said ratchet wheel positioned axially adjacent to one another on said pivot bolt and fixedly connected to one another;

a chain having a first end connected to the second one of said grips;

a tension spring for connecting a second end of said chain to said second section of said first grip;

said chain guided from said second grip across said sprocket wheel so as to be engaged by said sprocket wheel to said second section, where said chain extends in a longitudinal direction of said second section toward said tension spring;

a spring-biased follower pawl connected to said second section such that upon a closing movement of said second section said sprocket wheel and said ratchet wheel perform a rotational movement resulting in closing of said pliers;

said outer toothing of said ratchet wheel extending over the entire circumference of said sprocket wheel;

a spring-biased locking pawl for engaging said outer toothing, said locking pawl allowing a rotation of said ratchet wheel in a first direction during closing of said pliers, but preventing a rotation of said ratchet wheel in a second direction counter to said first direction; and an actuating member, connected to said locking pawl and accessible from the exterior of said pliers, for pivoting said locking pawl temporarily from engagement with said outer toothing into a disengaged position, wherein said actuating member is a transverse pin fixedly connected to said locking pawl and projecting perpendicularly from said locking pawl.

2. A pliers according to claim 1, wherein:

said first section has a wall with a slotted hole;

said transverse pin extends into said slotted hole so as to be guided therein; and said transverse pin has a free end extending through said slotted hole and projecting past said wall of said first section.

3. A pliers according to claim 2, further comprising a slide slidably connected to said second section and having an end face with glide surface, wherein said glide surface of said slide in an initial position is positioned adjacent to said transverse pin.

4. A pliers according to claim 3, wherein said slide has at least two slotted holes and wherein said second section has at least two bolts engaging respectively said at least two slotted holes for guiding said slide.

5. A pliers according to claim 4, wherein one of said at least two bolts is an axial extension of said pivot bolt.

6. A pliers according to claim 3, wherein:

said follower pawl has a pin connected thereto so as to extend perpendicularly from said follower pawl; and said slide has a lateral nose that during a return movement of said slide into said initial position acts on said pin of said follower pawl such that said follower pawl is moved into a release position.

7. A pliers according to claim 1, wherein:

said first section comprises a bolt;

said locking pawl is pivotably connected to said bolt; and said locking pawl comprises a spring for biasing said locking pawl into engagement with said outer toothing.

8. A pliers according to claim 1, further comprising a stationary glide member located within a circumferential area, in which said chain abuts on said sprocket wheel, so as to be positioned with play adjacent to said chain.

* * * * *